US006543359B2

(12) United States Patent
Bardet et al.

(10) Patent No.: US 6,543,359 B2
(45) Date of Patent: Apr. 8, 2003

(54) DETACHABLE INKING DEVICE FOR A FLEXOGRAPHIC PRINTING MACHINE, ITS EMBODIMENT, CLEANING AND USE IN SUCH A MACHINE

(75) Inventors: Gilbert Bardet, Lausanne (CH); Daniel Hürlimann, Prangins (CH); Patrick Lüscher, Cossonay-Ville (CH); Jean-Bernard Morisod, Villars-Ste-Croix (CH); Michel Piguet, Renens (CH)

(73) Assignee: Bobst SA (SE)

( * ) Notice: Subject to any disclaimer, the term of this patent is extended or adjusted under 35 U.S.C. 154(b) by 0 days.

(21) Appl. No.: 10/058,998

(22) Filed: Jan. 28, 2002

(65) Prior Publication Data

US 2002/0062751 A1 May 30, 2002

Related U.S. Application Data

(62) Division of application No. 09/517,476, filed on Mar. 2, 2000.

(30) Foreign Application Priority Data

Mar. 5, 1999 (CH) ..... 0412-99

(51) Int. Cl.[7] ..... B41F 35/00
(52) U.S. Cl. ..... 101/425; 101/350.6
(58) Field of Search ..... 101/350.6, 363, 101/366, 169, 484, 425

(56) References Cited

U.S. PATENT DOCUMENTS 5,181,470 A * 1/1993 Barrols et al. ..... 101/425
5,534,281 A * 7/1996 Pappas et al. ..... 101/169
5,570,633 A * 11/1996 Schultz et al. ..... 101/484
5,979,319 A * 11/1999 Hamauka et al. ..... 101/350.1

* cited by examiner

*Primary Examiner*—Eugene H. Eickholt
(74) *Attorney, Agent, or Firm*—Ostrolenk, Faber, Gerb & Soffen, LLP

(57) ABSTRACT

Detachable inking device for a flexographic printing machine, its embodiment, cleaning and use in such a machine. This device comprises a chambered doctor blade (9) mounted on two lever-supports (13, 14) crossed by duct joining pieces (15, 16) respectively. The lever-supports are rigidly attached to a shaft (11) about which they are pivotable and which is held between the frames (34) of said flexographic printing machine. Said chambered doctor blade (9) consists of a body (25) made of light metal material, crossed at one of its ends by a tube (26) emgerging from the bottom (28) of said body (25), and at the other end by a tube (40) having its opening part (29) at level with the bottom (28) of the body (25). The latter rests on seals (38, 39) secured to the lever-supports (13, 14) to which are attached centering and fixing means (17, 18) allowing a quick loosening of the chambered doctor blade (9) without the help of any tool. The body (25) comprises two plane and outwardly slanted projecting parts against which are glued two doctor blades (19, 20) by means of a gluing means (48). The doctor blades (19, 20) are also held at their ends by a supporting piece (21) having two supporting parts (35, 36) applying the ends of the doctor blades (19, 20) on an end seal (22). Said chambered doctor blade (9) can be handled by a manipulator (55) and conveyed into an automatic washing device (80) or a device (100) for gluing and ungluing said doctor blades (19, 20).

1 Claim, 8 Drawing Sheets

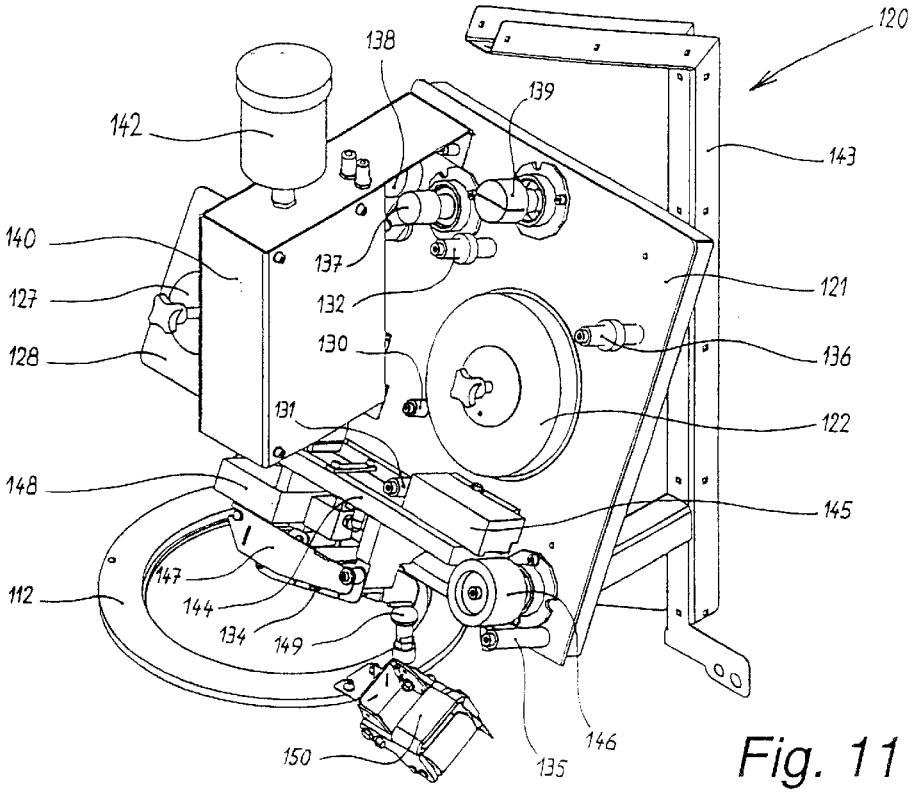
Fig. 11
Fig. 12
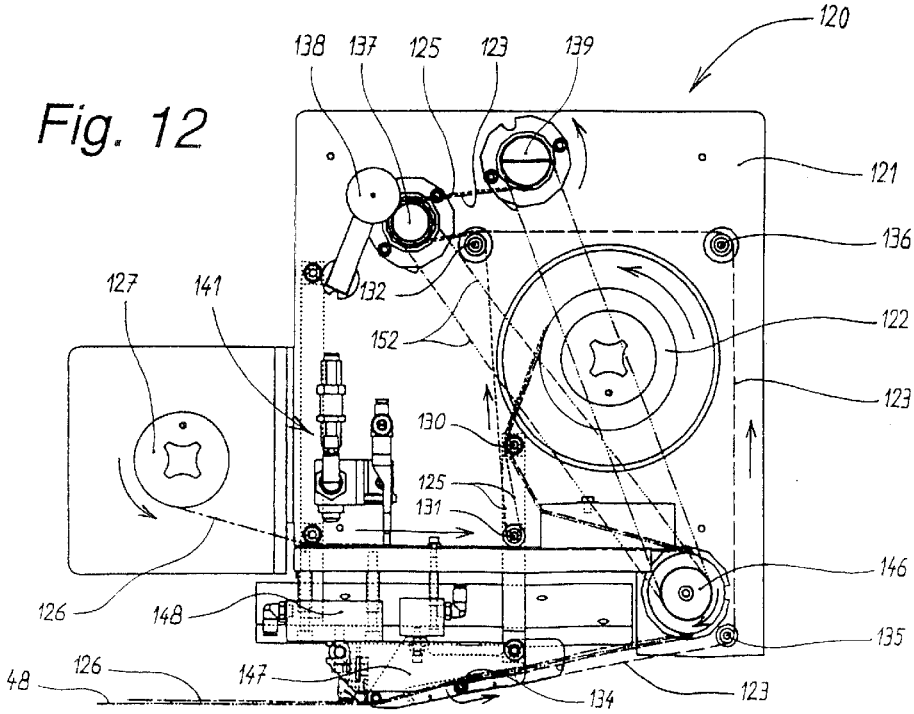

DETACHABLE INKING DEVICE FOR A FLEXOGRAPHIC PRINTING MACHINE, ITS EMBODIMENT, CLEANING AND USE IN SUCH A MACHINE

This is a division under 37 C.F.R. §1.53(b) of application Ser. No. 09/517,476, filed Mar. 2, 2000, by Gilbert Bardet. et al. entitled DETACHABLE INKING DEVICE FOR A FLEXOGRAPHIC PRINTING MACHINE, ITS EMBODIMENT, CLEANING AND USE IN SUCH A MACHINE.

The present invention refers to a detachable inking device for a flexographic printing machine, its embodiment, cleaning and use in such a machine.

The flexographic printing machines and, more particularly the printing stations of these machines comprise a plate cylinder, a pressure roller, a screened cylinder, commonly called anilox cylinder by the experts, and an inking device. The matter to be printed passes between the plate cylinder and the pressure roller. The screened cylinder, on which ink has been previously applied by the inking device, deposits the ink on the plate cylinder. To obtain four-coulour prints, for example, four printing stations are used, printing each a different colour. The inking devices, being generally used in the printing machines to deposit ink on the screened cylinder, are made up of a chambered doctor blade comprising a chambered doctor blade body on which are mounted two doctor blades coming in contact with the circumference of the screened cylinder. The ends of the chambered doctor blade are sealed by seals. The assembly thus formed constitutes a tank, wherein the ink will be brought, through an inking circuit, by means of a pump. Obviously, the printing machines, to which it is referred here, are adapted to provide a quantity of different printing jobs and in order to do so, all the components of each printing station need to be thoroughly cleaned. This thorough cleaning is relatively easy for components such as the plate cylinder and the screened cylinder but is more difficult as regards the chambered doctor blade which often comprises areas wherein ink residues still remain even after an intensive cleaning.

Each document U.S. Pat. No. 4,590,855, U.S. Pat. No. 5,150,651, EP 0 359 959 B1 and EP 0 611 649 B1 describe an inking devices being similar to the one we have just referred to.

The document U.S. Pat. No. 4,590,855 relates to a chambered doctor blade wherein the doctor blades are mounted on the chambered doctor blade body by means of a small bar holding the doctor blade by means of a hexagon head screw. The tightness of the chambered doctor blade ends is achieved by a seal cut in dependence on the diameter of the screened cylinder. An identical seal is fixed to each end of the chambered doctor blade body my means of a small plate crossed by hexagon head screws ensuring the clamping of the assembly. This chambered doctor blade is arranged so as to be pivotable from a working position against the screened cylinder to a rest position in which it is relatively easy to exchange the used or damaged doctor blades. Obviously, in this position, an additional operation, for example cleaning, can be carried out because of the access to the internal parts of the chambered doctor blade.

The document U.S. Pat. No. 5,150,651 describes a chambered doctor blade wherein the doctor blades are also mounted on the chambered doctor blade body by means of a small bar holding the doctor blade by means of a hexagon head screw. In this embodiment, it has been searched for the possibility of depositing ink in some transverse areas of the screened cylinder. For this purpose, the tightness of these areas, in the chambered doctor blade, is provided by seals which are cut in dependence on the diameter of the screened cylinder and the configuration of the internal part of the chambered doctor blade. Once that these seals are in the required position, they are maintained by the clamping of the doctor blades acting on a part of the seal. This chambered doctor blade is also arranged so as to be pivotable from a working position against the screened cylinder to a rest position in which it is relatively easy to exchange the used or damaged doctor blades and to adjust the position of the seals in the width of the chambered doctor blade. Also obviously, in this position, an additional operation, for example cleaning, can be carried out because of the access to the internal parts of the chambered doctor blade.

The document EP 0 359 959 B1 refers to a doctor blade inking device comprising a chambered doctor blade being detachably fixed on a crossbar which extends parallel to the screened cylinder. The crossbar includes fastenings for fitting or removing of at least one chambered doctor blade on this crossbar. The doctor blades are secured to the chambered doctor blade body in the same manner as has just been described with reference to the two previous patents. The assembly formed by the crossbar and the chambered doctor blade is also pivotable from an operating position to a rest position allowing the same handling operations as those previously cited in relation with the two mentioned U.S. patents.

The document EP 0 611 649 B1 relates to an inking apparatus wherein the doctor blades are held against the chambered doctor blade body by a clamping means comprising levers controlled by cylinders for clamping and loosening the doctor blades. In this device, the doctor blades are of magnetic material, such as a magnet, for temporarily holding the doctor blade against the chambered doctor blade before clamping it by the clamping device. This assembly, as those previously described, is also pivotably mounted in order to be able to carry out operations which are similar to the above-mentioned, this in a rest position.

As will be noted, in all the described devices the fitting and the fixing of the doctor blades achieves by means of clamping means consisting either of screws or of lever and cylinder devices applying their clamping force in punctual manner all along the doctor blade. In one of the cited examples, it has been endeavoured to improve the contact between the doctor blades and the chambered doctor blade body by using a magnetic material for the doctor blades and a ferrous material for the chambered doctor blade body. As has been explained, the inking means need to be thoroughly cleaned at each change of colour of the printing stations. Such a cleaning is also required when replacing a used or damaged doctor blade.

One of the major disadvantages of the devices using punctual clamping means lies in the fact that, when cleaning the chambered doctor blade it always remains ink residues attracted by capillarity between the internal part of the doctor blade and its supporting surface against the chambered doctor blade body. This phenomenon being particularly unpleasant when changing from a dark colour, for example black or blue, to a light colour such as yellow. This lack of cleaning causes a fading of the desired new colour, which is obviously unacceptable.

Another important disadvantage remains in the long time required for exchanging a used or damaged doctor blade, which is essentially due to the tedious removing and refitting of the clamping means of the doctor blades which comprise numerous components. Finally, the chambered doctor blades used in the known devices are of a heavy construction which renders their handling difficult when withdrawing them from the printing machine, which is required, for example for a repair or a thorough cleaning.

The aim of the present invention is to obviate the above-mentioned disadvantages and proposing a detachable inking device comprising an extremely lightweight chambered doctor blade.

For this purpose the inking device according to the invention corresponds to the description of claim 1.

The invention will be more clearly understood from the following description of an embodiment of an inking device for a flexographic printing machine given by way of non-limitative example and illustrated by the accompanying drawings, in which.

Figure 7:
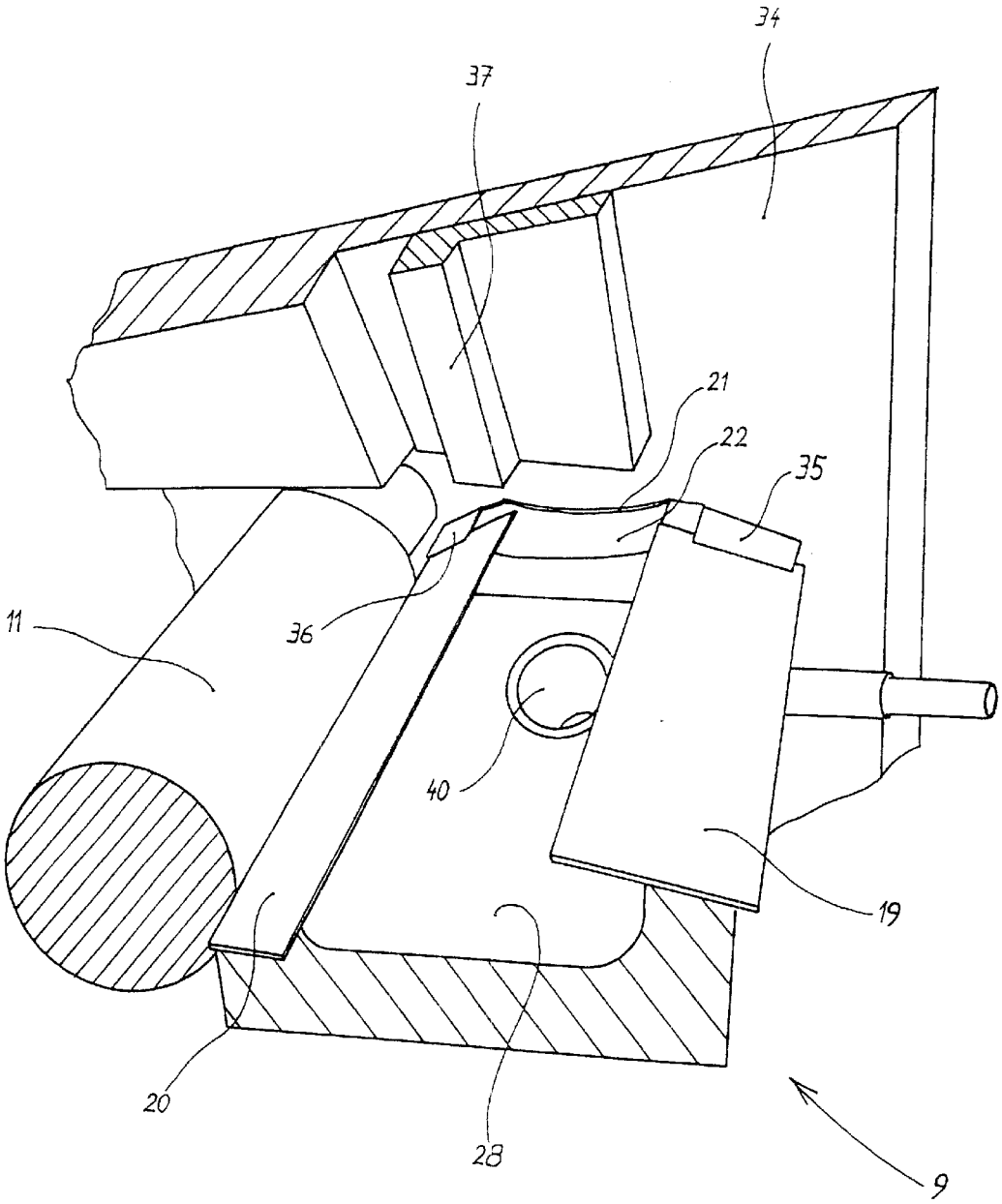
Figure 8:
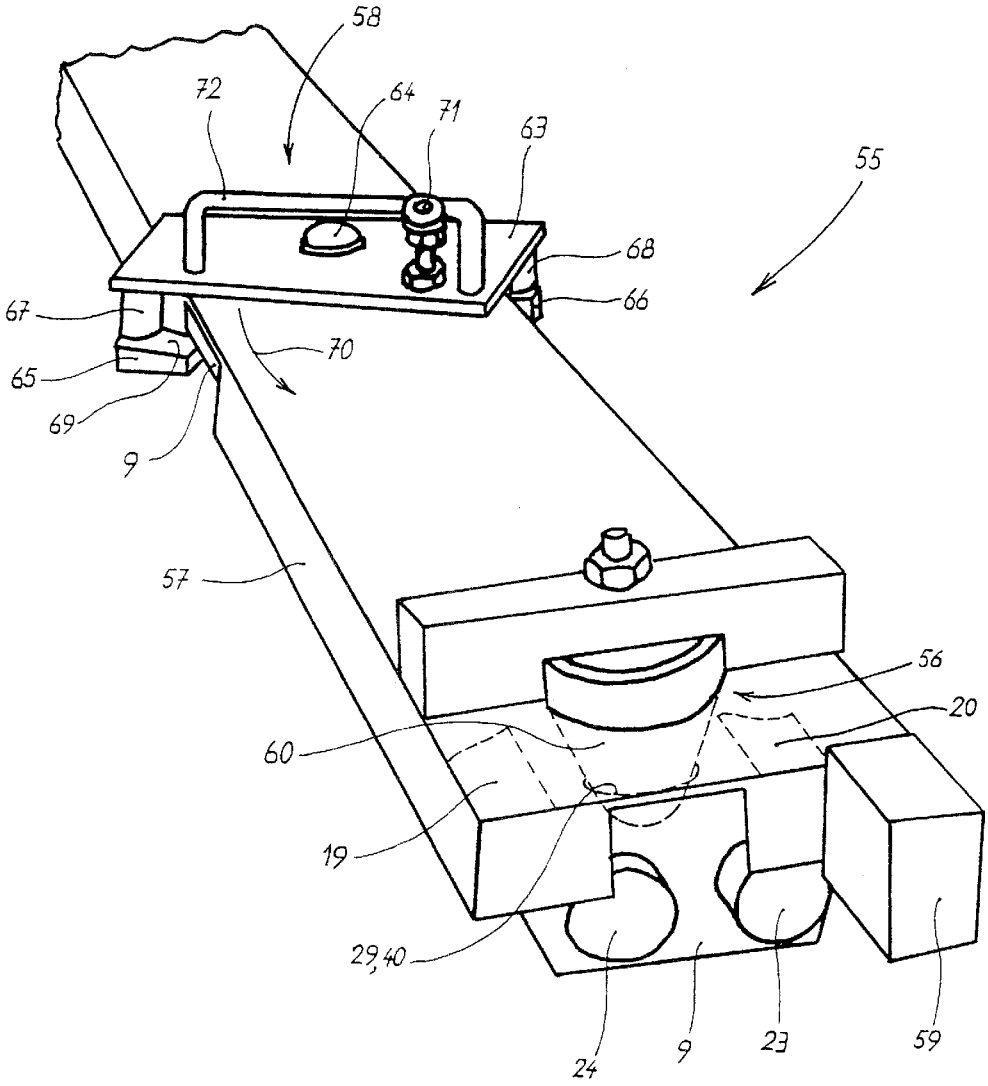
Figure 9:
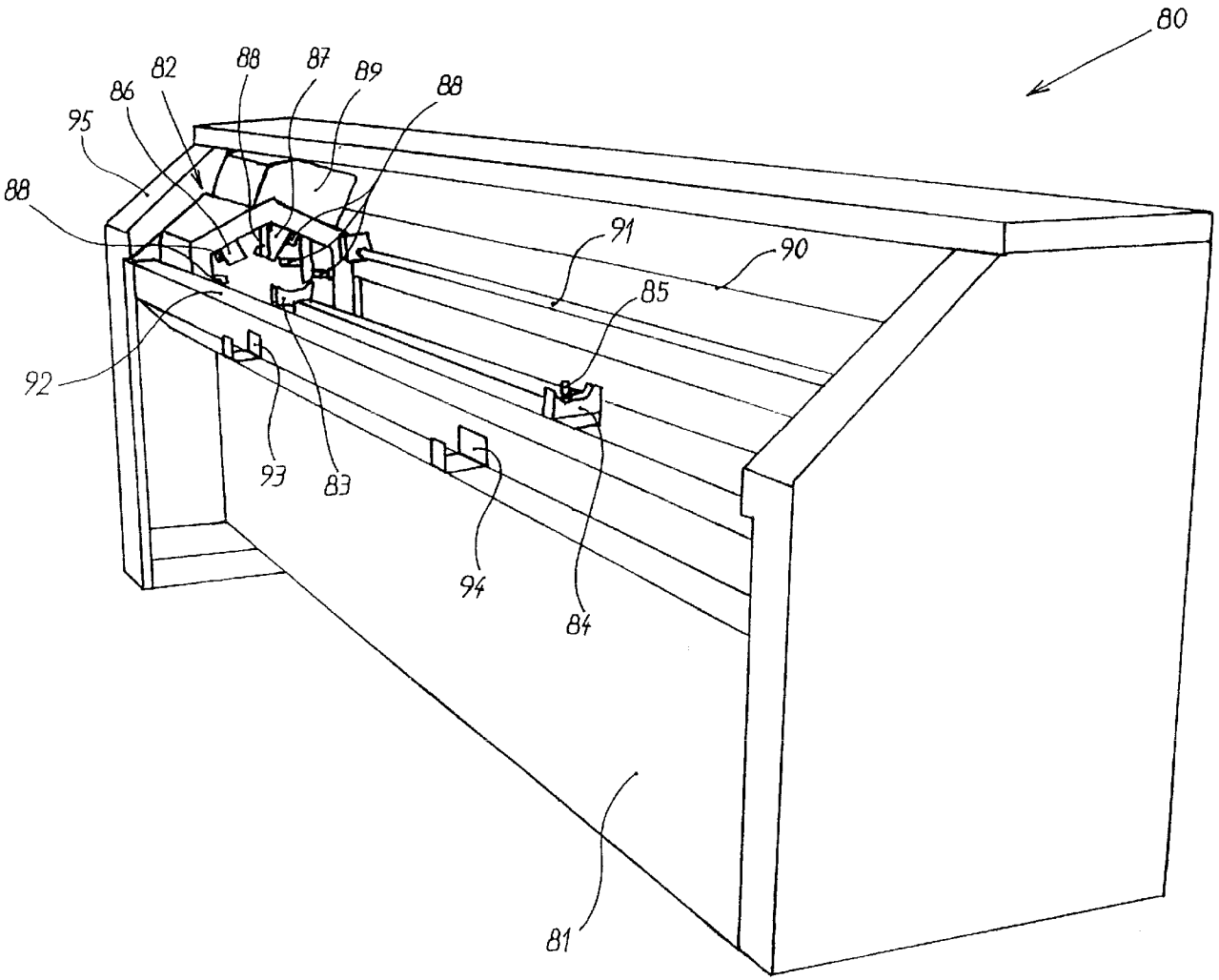
Figure 10:
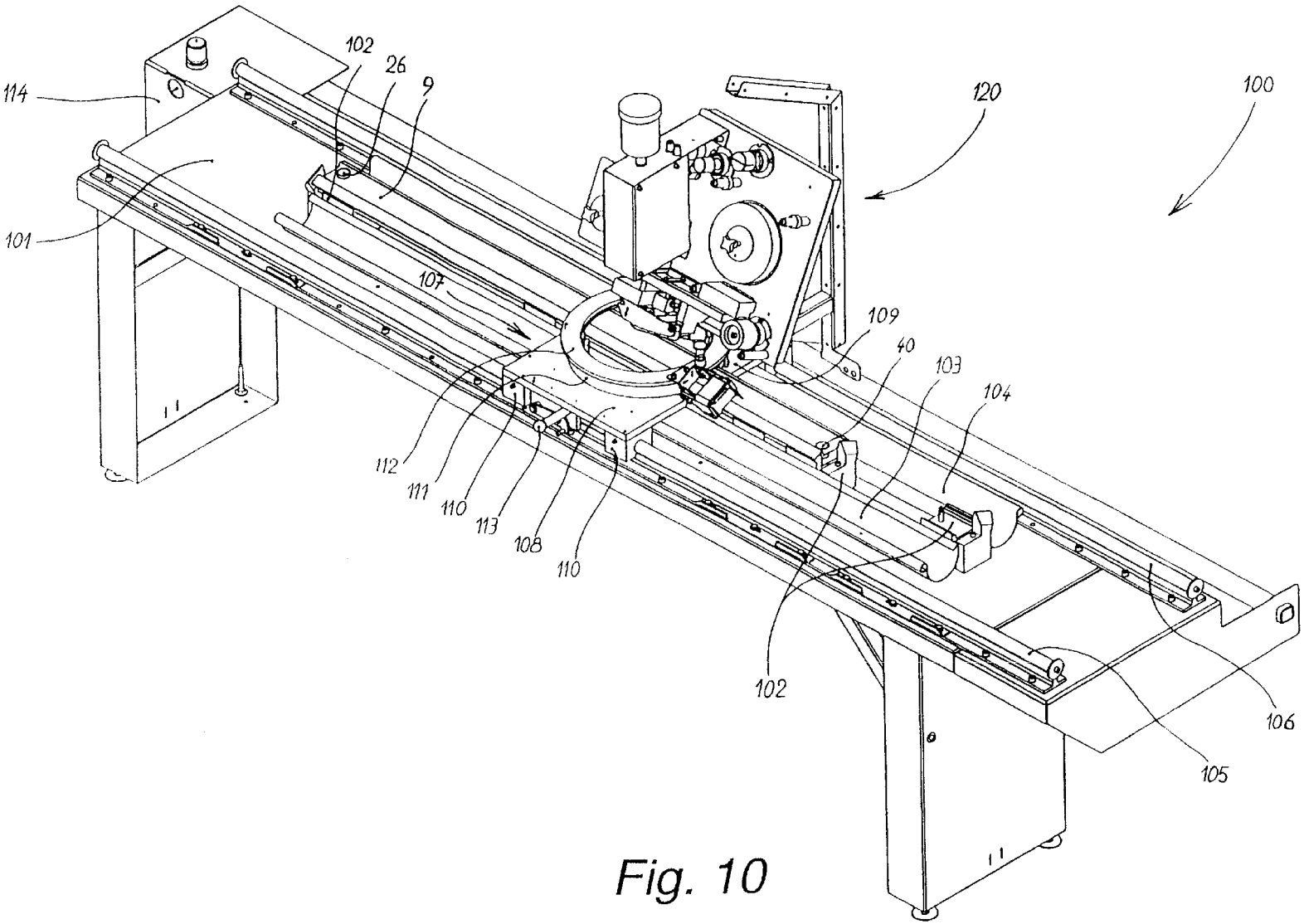

FIG. 7 is a perspective view of one of the ends of the chambered doctor blade, FIG. 8 is a perspective view of the handling device of the chambered doctor blade, FIG. 9 is a perspective view of the automatic washing device of the chambered doctor blade, FIG. 10 is a general perspective view of the gluing and ungluing device of the doctor blades, FIG. 11 is a perspective view of the gluing-ungluing means of the corresponding device, and FIG. 12 is a front view of the gluing-ungluing means.

Figure 1:
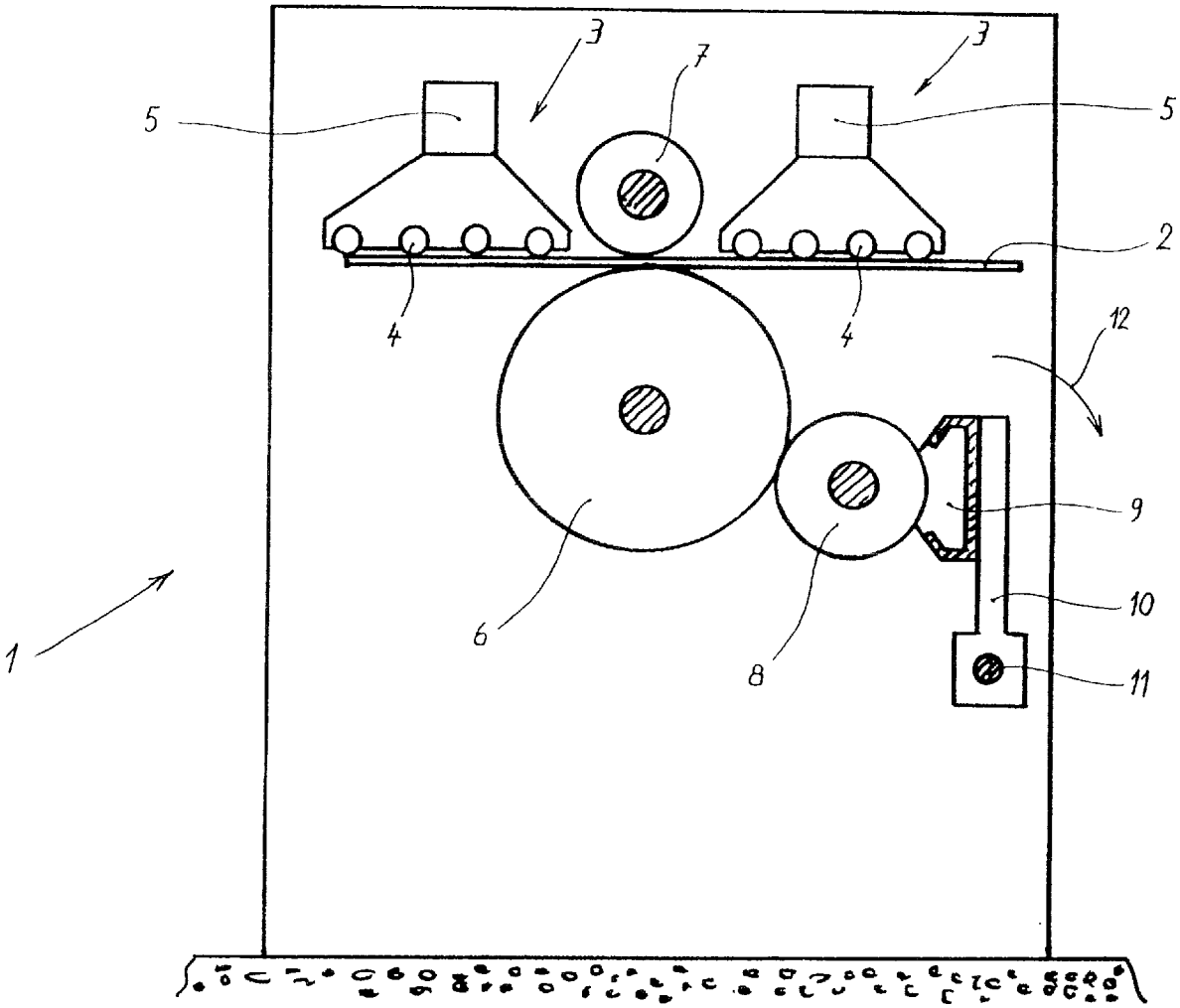
FIG. 1 is a schematic side view of a printing station.

FIG. 1 is a schematic side view of a printing station 1 wherein are represented the components of such a station. The sheets to be printed 2 are conveyed in a manner that their lower surface can be printed without being limited by the lower conveyor means. For this purpose, means such as suction conveyors 3 are used, consisting of drive rollers 4 secured to a suction device 5. The sheets to be printed 2, conveyed by the suction conveyors 3, are printed by a plate cylinder 6 cooperating with a pressure roller 7. The plate cylinder 6 receives the ink from a screened cylinder 8, commonly called "anilox" cylinder by the printing machine manufacturers. The screened cylinder 8 receives the required ink through a chambered doctor blade 9. This chambered doctor blade 9 is generally fixed on a chambered doctor blade support 10, which is pivotable, in the direction shown by arrow 12, about an rotational axis 11. This pivoting enables the chambered doctor blade 9 to be brought in a horizontal position in which handling operations can be carried out, for example, the cleaning of the chambered doctor blade, the exchange of the used or damaged doctor blades, the change of end seals and, finally, the complete removal of the chambered doctor blade 9 which is a relatively tedious operation often requiring the use of tools for loosening the fixing means of the chambered doctor blade 9 from its support 10.

Figure 2:
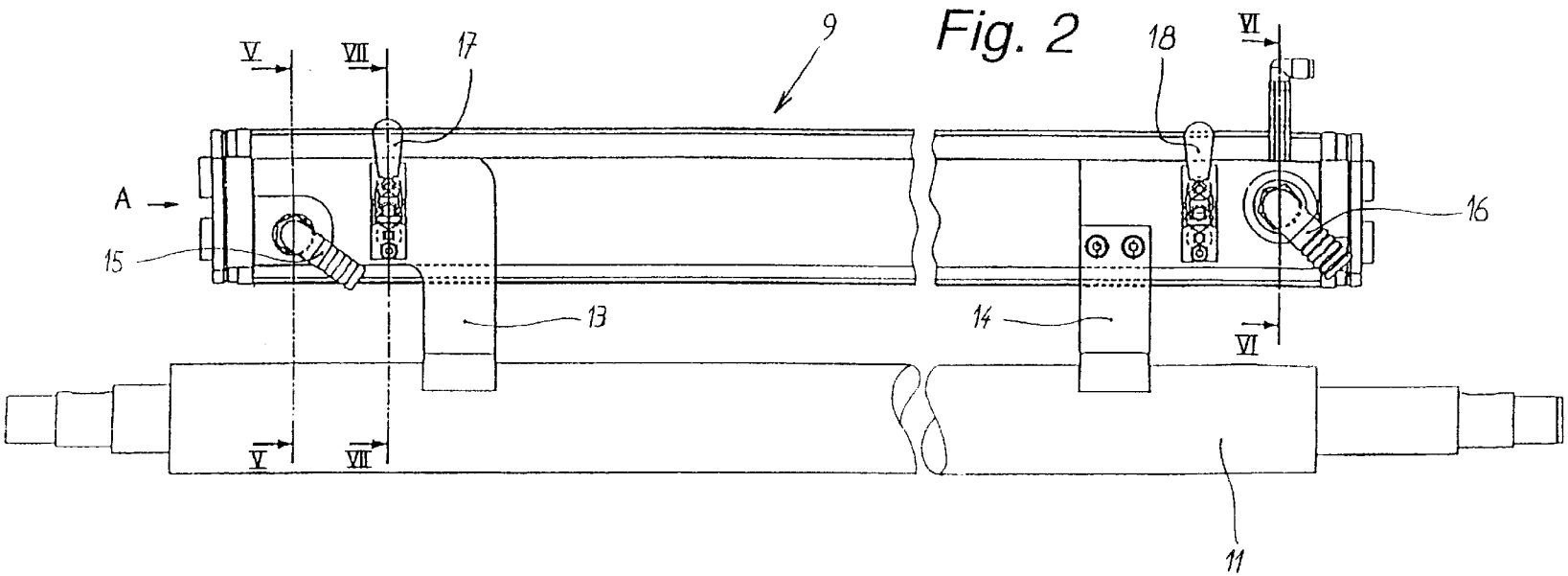
FIG. 2 is rear view, in elevation, of a chambered doctor blade.

FIG. 2 is a rear view, in elevation, of a chambered doctor blade 9 illustrating the manner of connecting the chambered doctor blade 9 with its rotational axis 11 by means of lever-supports 13 and 14 in which are fastened the joining pieces 15 and 16 for the supply and return of the ink in the chambered doctor blade 9. The connection between the lever-supports 13 and 14 and the chambered doctor blade 9 is ensured by means of seals 38, 39 (see FIGS. 5 and 6), so that the chambered doctor blade 9 can be disconnected from its levers-supports 13 and 14 without having to remove the ducts supplying or withdrawing the ink from the chambered doctor blade 9. This kind of connection between the chambered doctor blade 9 and its levers-supports 13 and 14 allows a simple extraction without any problem of the chambered doctor blade 9 from the printing station 1 so that all the required handling operations can be performed outside the machine. The lever-supports 13 and 14 are moreover equipped with centering and fixing means 17 and 18. These centering and fixing means 17 and 18 are on general sale and allow a quick loosening of the chambered doctor blade 9 without the help of any tool.

Figure 3:
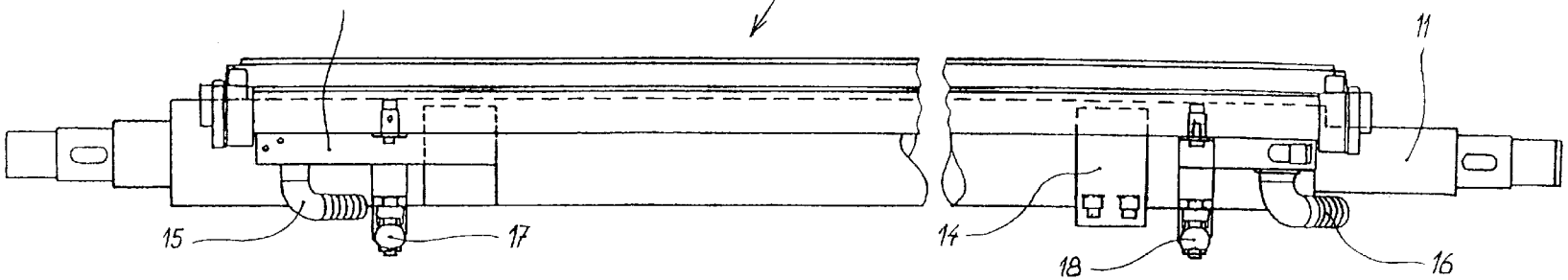
FIG. 3 is a plan view of the chambered doctor blade of FIG. 2.

FIG. 3 is a plan view of the chambered doctor blade of FIG. 2 representing the various components of FIG. 2 with identical reference numerals.

Figure 4:
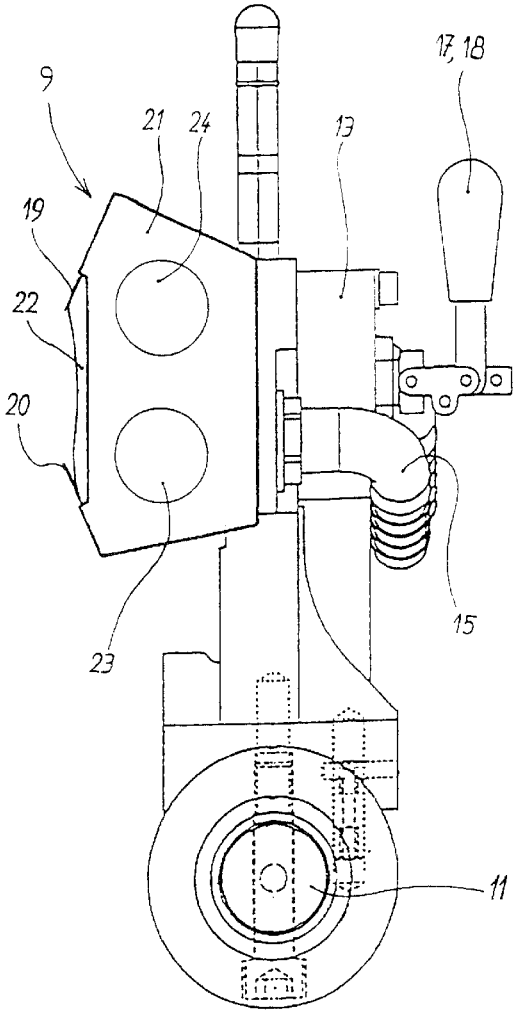
FIG. 4 is a view according to A of FIG. 2.

FIG. 4 is a view according to A of FIG. 2 representing one of the ends of the chambered doctor blade 9. This figure shows in particular the manner in which the doctor blades 19 and 20 are held in their ends by means of a supporting piece 21 cooperating with the end seal 22 of the chambered doctor blade 9, this in order to ensure the fixing of the ends of the doctor blades 19 and 20. The supporting piece 21 is fitted against the end seal 22 of the chambered doctor blade 9 by means of two knurled screws 23 and 24.

Figure 5:
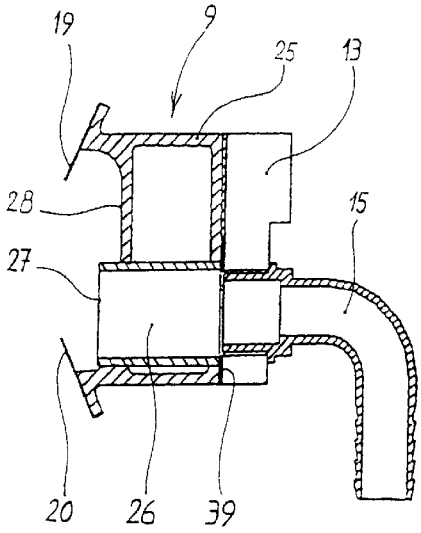
FIG. 5 is a sectional view according to V—V of FIG. 2.

FIG. 5 is a sectional view according to V—V of FIG. 2 representing the body 25 made of aluminum or any other light material such as composite materials, used for the body of the chambered doctor blade 9. The outlet 27 of the ink tube 26 emerges from the bottom 28 of the chambered doctor blade body 9 so as to avoid escapement of the residual ink from the chambered doctor blade 9 when withdrawing it from the printing station 1 and, for example, during its transport to a cleaning station provided in the press room. This figure also shows the seal 39 arranged in the lever-support 13 and ensuring the tightness between the chambered doctor blade 9 and said lever-support 13. The doctor blades 19 and 20 are also shown in this figure and the manner of fixing them to the chambered doctor blade body 9 will be given further in the present description.

Figure 6:
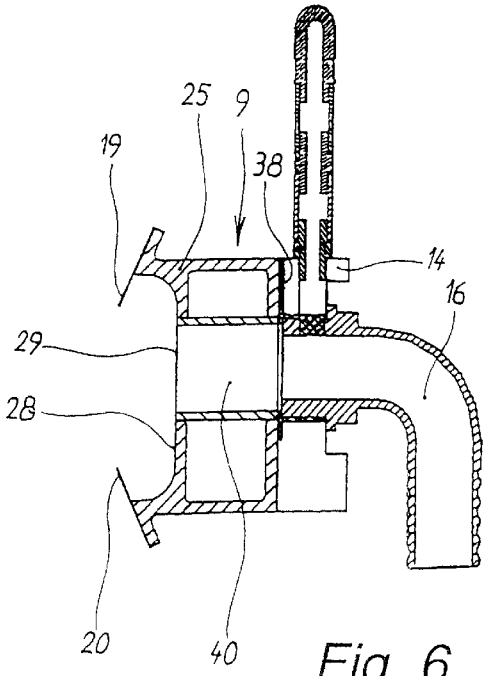
FIG. 6 is a sectional view according to VI—VI of FIG. 2.

FIG. 6 is a sectional view according to VI—VI of FIG. 2 showing the ink supply tube 40 connected to the joining piece 16. The opening part of the ink supply tube 40 is at level with the bottom 28 of the chambered doctor blade body 9 to provide an almost complete outflow of the ink remaining in the chambered doctor blade 9 at the time of its putting out of action. As will be seen hereinafter, this opening will be sealed by an adequate seal belonging to a safety and handling device of the chambered doctor blade 9.

FIG. 7 is a perspective view of one of the ends of the chambered doctor blade 9. The other end of the chambered doctor blade 9 being made in the same manner. This figure shows the chambered doctor blade 9 in its rest position, i.e. when it is not in contact with the screened cylinder 8. The chambered doctor blade 9 is fitted between two lateral frames 34, only one of which being represented in this figure. In particular, this figure shows the manner of holding the ends of the doctor blades 19 and 20 by the supporting piece 21 which has two supporting parts 35 and 36 maintaining the ends of the doctor blades 19 and 20 in contact with their supporting surfaces on the end seal 22. Also represented here is the guiding slide 37 which allows easy positioning of a manipulator 55 (see FIG. 8) on the chambered doctor blade 9 when it is to be withdrawn from the printing station 1. The guiding slide 37 is fitted against the internal surface of each lateral frame 34 by means of screws (not shown). FIG. 7 clearly shows that the doctor blades 19 and 20 are not held by mechanical means. The doctor blades 19 and 20 are made of a nonoxidizing steel belt whose thickness may vary in dependence on the jobs to be carried out but preferably having a thickness of 0.15 to 0.2 mm. This non-oxidizing steel belt receives, before being applied against the upper supporting surfaces of the chambered doctor blade 9 and after having been degreased and tried, a gluing means 48. The non-oxidizing steel band provided with the gluing means 48 is then mechanically applied, with a certain pressure, against the upper supporting surfaces of the chambered doctor blade body 9. This solution thus enables complete removal of the capillarity effect, which arises with conventional fixing means of doctor blades, and also allows the exchange of the damaged or used doctor blades 19 and 20 by peeling, using the same apparatus as for the gluing of the doctor blades 19 and 20. The combination of a light chambered doctor blade body with a fixing of the doctor blades without mechanical means provides a chambered doctor blade having a considerably lighter weight than the existing chambered doctor blades, thus allowing easy handling of the latter.

This easy handling of the chambered doctor blade 9 as well as the simplicity of removal from the machine thus allow quick exchange with another chambered doctor blade which has been previously cleaned and possibly repaired outside the machine by means of auxiliary devices which will be described now. The advantage of operating outside the machine is that it is simultaneously possible to carry out printing jobs and prepare intending tasks "en temps masque". A manipulator 55 is used to extract the chambered doctor blade 9 from the printing station 1, thus keeping an excellent safety level.

FIG. 8 shows one of the ends of a manipulator 55, since the other end is practically similar, apart from a tightness means 56, it will not be described here. The manipulator 55 consists of a channel 57 adapted to cover the upper part of the chambered doctor blade 9. This channel 57 is equipped with two fixing devices 58 (only one of which being shown in this figure, the other, identical one, being located at the same place at the other end of the channel 57). In addition, each end of the channel 57 is provided with a guiding block 59 which facilitates the positioning of the manipulator 55. The guiding block 59 engages each guiding slide 37 shown in FIG. 7. The tightness means 56 consists of a conical seal 60 mounted on the upper part of the channel 57. The conical seal 60 is adapted to seal the outlet 29 of the ink supply tube 40 so as to provide the tightness of the chambered doctor blade 9 when it is to be extracted from the printing station 1. The fixing device 58 consists of a plate 63, which is mounted so as to be pivotable about an axis 64 on the upper part of the channel 57. The plate 63 is provided with two small clamping plates 65 and 66 carried by a spacer 67, 68 respectively. The small clamping plates 65 and 66 have a slanted plane 69 acting, when rotating opposite to the direction shown by the arrow 70, against the lower surface of the chambered doctor blade 9, thus securing it to the manipulator 55, as shown in the present figure. The fixing device 58 is locked, in the clamping position shown in this figure, by means of a bolt 71, which is manually actuated so as to allow rotation, in the direction shown by the arrow 70, of the fixing device 58 when it is required to withdraw the manipulator 55 from the chambered doctor blade 9. Each plate 63 is additionally provided with a handle 72. This system allows locking and unlocking of the manipulator 55 with only one finger without releasing the transporting handles 72. One of these auxiliary devices, required for the above-mentioned handling of the chambered doctor blade 9, consists of an apparatus such as the one represented in FIG. 8.

FIG. 9 shows an automatic washing device 80 for cleaning the chambered doctor blade 9 outside the machine. This device consists of a frame 81, inside of which moves a washing head 82 along the chambered doctor blade 9 which has been previously placed on two hollow supports 83 and 84 by means of the manipulator 55. The support 84 is provided with a centering pin 85 which makes the adjusting of the placing of the chambered doctor blade 9 on these supports easier. The washing head 82 is equipped with two rotary brushes 86 and 87 as well as a plurality of washing nozzles 88. The rotary brushes 86 and 87 are arranged so as to be able to clean at best the surfaces of the doctor blades 19 and 20, and the nozzles 88 are judiciously oriented so as to remove all ink residues on the chambered doctor blade 9. The displacement of the washing head along the chambered doctor blade is ensured by a motor mounted in a casing 89 on the washing head 82, which moves along a toothed belt 90 fixedly tightened between the lateral walls of the frame 81. This bidirectional displacement is guided by a cylindrical bar 91 and a carrying rail 92. The front surface of the latter is equipped with two supports 93 and 94 adapted to receive the manipulator 55 for storing it. Finally, a control panel 95 allows controlling of said washing device 80.

FIG. 10 is a general perspective view of the device 100 for gluing and ungluing the doctor blades 19 and 20 to and from the chambered doctor blade 9. This device comprises a table 101 on which are attached fitting jigs 102 to facilitate the adequate positioning of the chambered doctor blade 9 in the device 100. Two longitudinal semicircular receptacles 103 and 104 are located on both sides of these jigs for directly receiving the respective used doctor blades 19 and 20 when they are removed from the chambered doctor blade 9 by the present device 100. Along the longitudinal edges of the table 101 are mounted two bars 105, 106 on which travels a carriage 107 consisting of two half plates 108, 109 which slide on the bars 105, 106 by means of two pairs of blocks 110. The two half plates are secured to one another by a circular rail 111 screwed on their upper surface. On this circular rail turns a large ring 112 on which is mounted a gluing-ungluing means 120. The displacement of the carriage 107 achieves manually by means of a handle 113 without excluding, however, of being motorized. A desk 114 allows to control the compressed air supply system of certain parts of the gluing-ungluing device 120, more particularly the parts for application, sectioning and degreasing and drying of the doctor blade.

FIG. 11 is a perspective view of the gluing-ungluing means 120 of the corresponding device 100. This means 120 consists of a slanted plate 121, on the front surface of which are mounted various components for the automatic placing of, firstly, a gluing means 48 (FIG. 12) against a foil 126, then secondly and simultaneously, this foil 126 against the two supporting surfaces forming the upper parts of the chambered doctor blade body 9. Being sectioned to the right length, this foil 126, in the end, forms the doctor blades 19 and 20 mounted on the chambered doctor blade body 9. In a preferred but nonlimitative embodiment, the gluing means 48 is made of a double-faced adhesive tape from a roller 122, which is rotarily held against the front surface of the plate 121. This adhesive tape comprises two unglueable protective surfaces, the upper protective surface 125 of which passing, in the following order, around rods 130, 131 and 132 and the lower protective surface 123 around rods 130, 134, 135, 136 and 132. After being unglued from the adhesive tape 48, the two protective tapes 123 and 125 both pass around a driven shaft 137, against which a tension roller 138 is applied, then winds around a rewinder shaft 139. A support 128, rotarily receiving a foil roller 127, is mounted against the plate 121. A housing 140, which is likewise fitted against the latter, contains the cleaning device of the foil 126. The latter comprises a means 141 (FIG. 12) for spraying a degreaser and for drying the foil. The spraying fluid is contained in a tank 142 located above the housing 140. A vertical bent channel 143 is used to support compressed air ducts which open into the housing 140 and are connected to the control desk 114 (FIG. 10). During cleaning, the foil 126 passes in a supply channel 144 being topped at one end with a guiding box 145 for adjusting the adhesive tape 48, which has been separated from its upper protective surface 125, against the cleaned surface of the foil 126 in order to glue it. Then, the latter passes around a drive shaft 146 before the second protective surface 123 is separated from the adhesive tape 48 at the level of the rod 134. At this stage, the foil 126 is already in a pressing means 147 comprising a roller or a pressure shoe which applies the adhesive surface of the latter against the upper supporting surfaces of the chambered doctor blade body 9. A cutting means 148 of the foil 126 is located directly behind and above this pressure means 147 and comprises a guillotine actuated by a cylinder. The pressure means 147 and the cutting means 148 are both likewise pneumatically controlled by the desk 114.

The assembly of the gluing-ungluing means 120 is turnable in a vertical plane owing to the pair formed by the circular rail 111 and the ring 112, so that the gluing and ungluing operations can be carried out on both upper surfaces of the chambered doctor blade body. The accuracy of the angular rotation of the means 120 is ensured by a finger 149 adjusting in perforated holes in the circular rail 111. The used or damaged doctor blades are unglued owing to the ungluing means 150 which is mounted against the upper surface of the ring 112. This organ simply lifts the doctor blade by a tail provided at one of its ends and unglues it, with the adhesive tape, in order to drop it on the sides into the receptacles 103, 104 having the shape of gutters (FIG. 10).

FIG. 12 is a front view of the front part of the plate 121 on which are mounted the various elements previously described with reference to FIG. 11. According to the different arrows in this drawing, the latter illustrates the paths of the foil 126, the adhesive tape 48 and the two protective surfaces 123 and 125. Two belts 151 and 152 are also represented, though being located behind the plate 121 on pulleys secured to the shafts 139 and 146 for the belt 151, and 137 and 146 for the belt 152. Obviously, the pulley (having two grooves) of the shaft 146 is driven by the unwinding of the foil 126 applied on the upper supporting surfaces of the chambered doctor blade body, thus advantageously avoiding any adverse synchronism between the unwinding speed of this foil and the displacement speed of the carriage 107 along the bars 105, 106.

Numerous improvements can be made to this device, embodiment, cleaning and use in a flexographic printing machine within the scope of the claims.

What is claimed is:

1. An automatic washing device for a chambered doctor blade detachable from a flexographic printing machine by use of a manipulating device, the printing machine including a chambered doctor blade, the washing device including:

a frame;

a movable washing head mounted on the frame, the washing head being comprised of a plurality of rotary brushes and nozzles;

two hollow supports for the chambered doctor blade, at least one of which is provided with a centering device, the movement of the washing head being guided by a guide secured to the frame and by a carrying rail, the carrying rail including two support members located on the front surface thereof which receive the manipulating device carrying the chambered doctor blade;

a motor having a motor shaft; the movement of the washing head being actuated by the rotation of a motor shaft, the motor being mounted on the washing head and engaging with a toothed belt for converting the rotation of the motor shaft to rectilinear bidirectional movement.

* * * * *